US005359915A

United States Patent [19]

Hitz

[11] Patent Number: 5,359,915

[45] Date of Patent: Nov. 1, 1994

[54] WEB CUTTER

[75] Inventor: Mark A. Hitz, Granada Hills, Calif.

[73] Assignee: Datametrics Corporation, Chatsworth, Calif.

[21] Appl. No.: 73,897

[22] Filed: Jun. 9, 1993

[51] Int. Cl.[5] ..... B26D 1/56

[52] U.S. Cl. ..... 83/342; 83/349; 83/583

[58] Field of Search ..... 83/341, 342, 349, 582, 83/583, 588, 672, 674, 343, 345, 348

[56] References Cited

U.S. PATENT DOCUMENTS

| | | | |
|---|---|---|---|
| 1,963,873 | 6/1934 | Smith | 83/583 X |
| 4,114,491 | 9/1978 | Hashimoto et al. | 83/349 X |
| 4,244,251 | 1/1981 | Iwao et al. | 83/349 |
| 4,651,605 | 3/1987 | Dean, II | 83/349 X |
| 4,667,554 | 5/1987 | Peery | 83/583 |
| 4,914,995 | 4/1990 | Osborn | 83/348 X |
| 4,936,177 | 6/1990 | Ozawa et al. | 83/582 |

*Primary Examiner*—Eugenia Jones
*Attorney, Agent, or Firm*—Marvin H. Kleinberg

[57] ABSTRACT

A high speed web cutter has a rotating roller with an extended bar mounted perpendicular to its surface and angled to be aligned askew with respect to the roller's axis. During the rotation of the roller, the bar interferingly contacts a plate having an angled edge that is mounted on a relatively stiff cantilever spring. The bar edge and the plate edge are not mounted parallel with each other nor are either of them parallel with the plane of the web. As the roller rotates, the extended bar deflects the cantilever spring, allowing the edges to intersect in a cutting intersection that travels axially with roller rotation, thereby severing a web member passing between the roller and the plate edge.

16 Claims, 3 Drawing Sheets

WEB CUTTER

BACKGROUND OF THE INVENTION

The present invention relates to cutting devices, particularly, a relatively high speed cutter to be used on a moving web.

In the past, traveling webs have been cut at a station in which web travel has been halted. A knife blade acting against a supporting edge moves in a generally vertical path with respect to a horizontally moving web. The blade may be angled so that as the blade moves in the vertical direction, the area of intersection of the blade with the backing plate appears to translate in a direction transverse to the direction of web travel.

This angled cutting, which can be found in most paper cutters, and for example, the guillotine, only cuts a small increment of the web at any given time in the travel of the blade. Accordingly, less cutting force is required.

An alternative cutting device for use with a moving web also uses a "travelling" cutting edge. A matched pair of rollers are positioned with their axes transverse to the path of the web. One of the rollers has a blade that is embedded in the roller. The opposing roller may have either a matching plate or may be of a resilient material that deforms under the blade. As the roller rotates, the knife edge effectively traverses the width of the web. Since the web is moving, the rollers may be angled slightly in the direction of web travel so that cut will be at right angles to the web edge.

Such a device must be provided with some mechanism that permits it to "idle" or remain out of engagement with the web until the web is to be cut into the desired length. This may require bringing one or both rollers in and out of engagement with the web. Other approaches may require that the rollers be provided with clutches that can be selectively engaged when a cut is required.

Further, prior art web cutting systems required blades which came to a sharp cutting edge with either a single or double taper. Such blades quickly dull and are dangerous to handle. Further, such blades present a substantial hazard to workers because of the sharpness of the cutting edge.

Scissors or shears rely on relatively thicker blades with a substantially right angled edge. The blades are joined at a pivot point and are mounted to be intersecting at a shallow angle. Because of the flexibility of the blades, the point of intersection travels outward from the pivot point with the blades displacing each other sufficiently to allow a cutting intersection to travel to the free ends of the blades.

It would be desirable to adapt the "scissors-type" cutting action of shears to the problem of cutting a traveling web. In fact, if a flexible web is driven to the cutter and the cutting action is rapid enough, the web can be momentarily halted while the cutter is employed. The cut section can be removed and the web can then continue until another cut is commanded.

SUMMARY OF THE INVENTION

According to the present invention, a high speed, novel web cutter is provided at the output end of a printer or other device which operates in conjunction with a moving web. The web may be paper, plastic or fabric and may even include metallic foils. In a preferred embodiment, the web is paper.

A roller with an extended bar having a right or acute angled edge extending in the axial direction cooperates with a plate having a right or acute angled edge that is mounted on a relatively stiff, cantilever spring. Both edges are in planes that are not parallel with the plane of the web but are at a predetermined angle with respect to the plane of the web.

When the roller is rotated, one end of the roller mounted bar edge overlaps the plate slightly. The roller mounted bar edge engages the plate and depresses the plate against the spring until the roller edge "clears" the plate edge. The angled orientation of the plate and roller edges creates a traveling point of intersection as the roller continues to rotate at a relatively high rate of rotation.

A web that is between the roller and the plate is rapidly cut by the moving intersection of the edges. When the roller edge completely clears the plate edge, the roller is free to rotate to an initial, rest position. The circumferential velocity of the roller is much greater than the speed of web travel.

Accordingly, it is an object of the invention to provide an improved web cutter that can be operated selectively to provide cut pages of variable length.

It is a further object of invention to provide a high speed web cutter that can operate with a moving web.

It is an additional object of the invention to have a web cutter that utilizes a scissor action with a moving point of intersection.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DETAILED DESCRIPTION OF THE PREFERRED EMBODIMENTS

Figure 1:
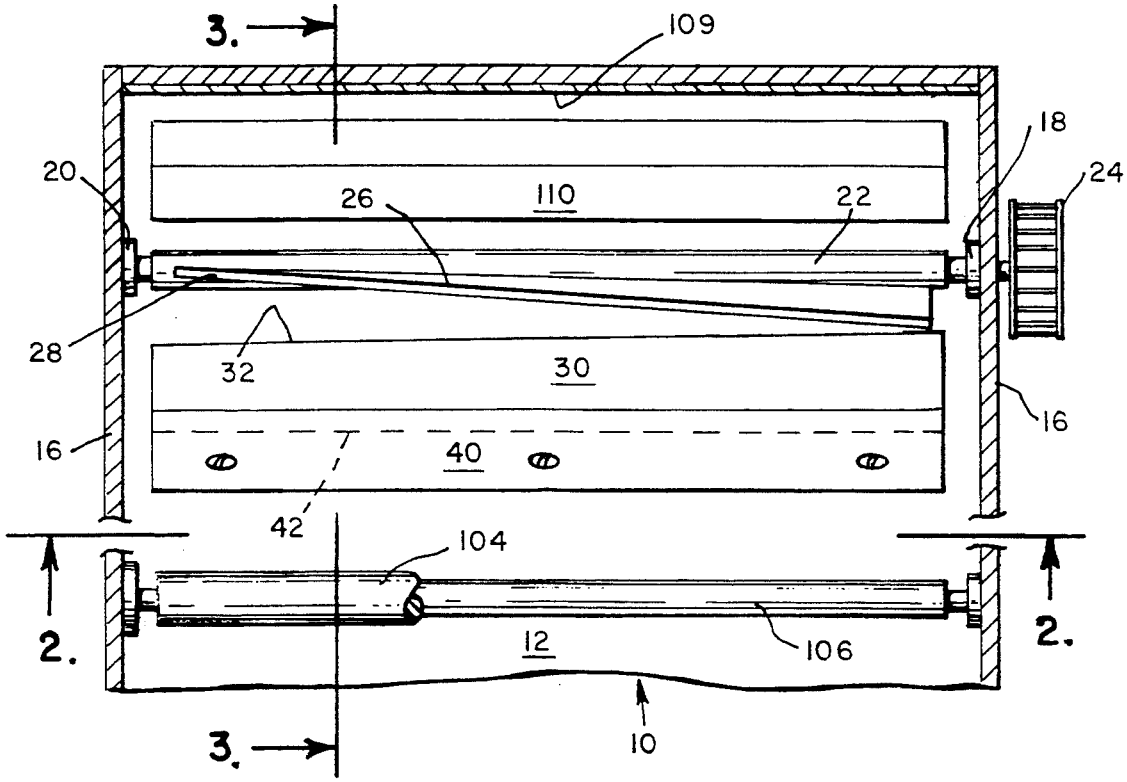
FIG. 1 is a top view of a web cutter embodying the present invention.

FIGS. 1 through 4 illustrate the general appearance of a web cutter as constructed in accordance with the invention disclosed and claimed herein. A preferred embodiment of the invention in the form of a paper cutter 10 as illustrated in FIG. 1, is preferably constructed of metal to be sufficiently durable for the cutting of paper or other web material at high speed. Other web materials such as thin film plastics, fabrics or metal foils may also be used with the present invention.

Cutter 10 in the preferred embodiment has a frame 12 forming the base of the device. Frame 12 has a driven end 14 and an opposite end 16. Each of the ends of frame 12 contains a bearing, 18 and 20 respectively, for supporting each end of a roller 22. Roller 22 extends between the opposite ends 14, 16. At the driven end 14, roller 22 has an axial extension that protrudes through the bearing and beyond end 14 in order to receive a pulley 24 which is driven by a motor, not shown.

A cutting bar 26 is detachably mounted on roller 22 and extends between the opposite end 16 and the driven end 14. It should be noted that cutting bar 26 is not centrally aligned to the longitudinal axis of roller 22. Rather, it is skewed slightly to the right with respect to the longitudinal axis as shown in FIG. 1. Cutting bar 26 has a cutting edge 28 (best seen in FIGS. 3 and 4) which may be sharpened easily due to the fact that bar edge is detachably mounted on roller 22.

Illustrated in FIGS. 1 through 4 is a plate 30 which has a stationary edge 32 (best seen in FIGS. 3 and 4) which is positioned so as to operate cooperatively with cutting edge 28. Plate 30 is detachably mounted on a suitably stiff cantilever spring 40 which is mounted on a support 42 by means of fasteners 44 (best seen in FIG. 2).

Figure 3:
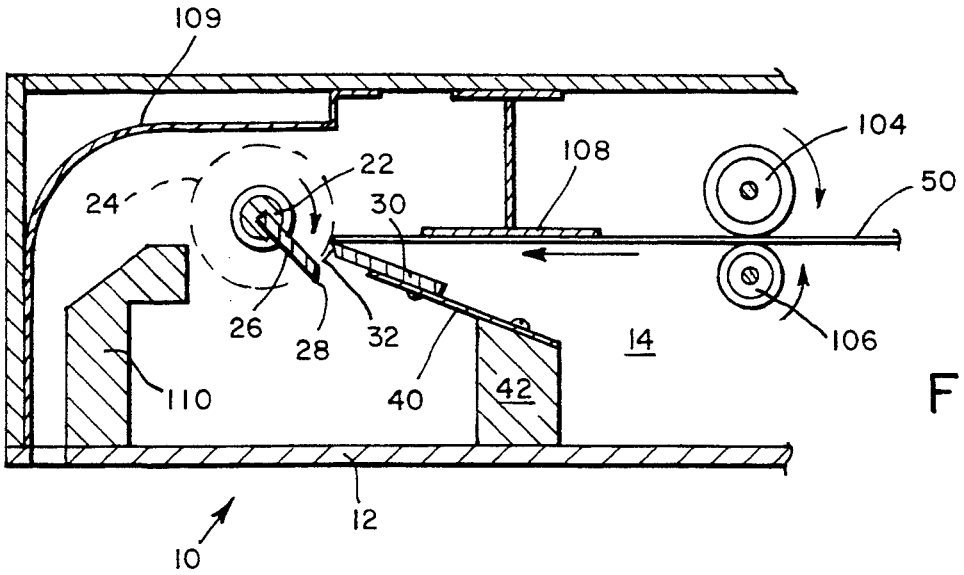
FIG. 3 is a cross-sectional view of the invention of FIG. 1, taken along line 3—3 in FIG. 1 in the direction of the appended arrows, with a web of material and a web guide.
Figure 4:
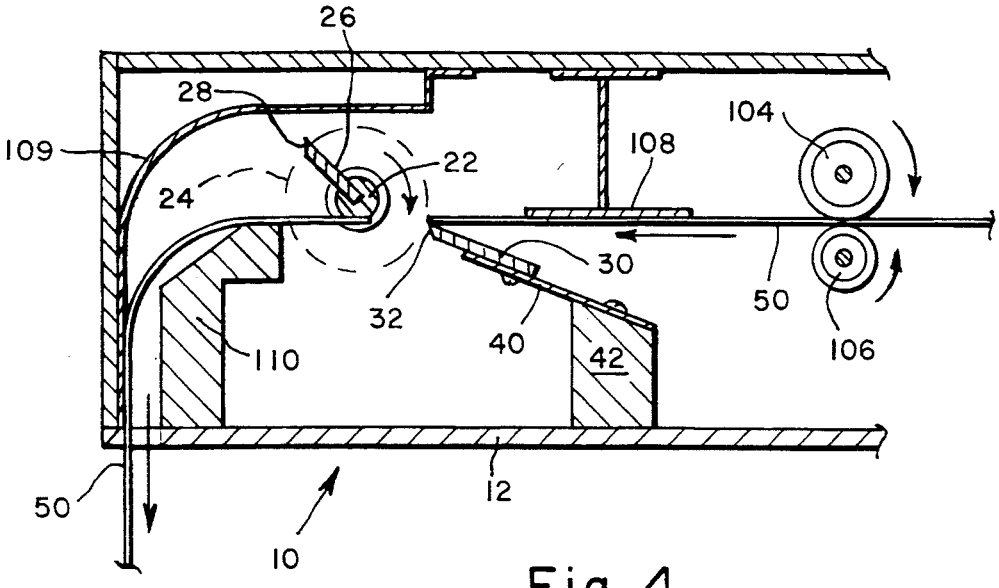
FIG. 4 is the same cross-sectional view as FIG. 3 except that the web material has not been cut.

As can be seen in FIGS. 3 and 4, plate edge 30 is located just below the plane of a traveling web material to be cut. When a continuous web 50 of material is fed over the stationary edge 32, the web material is allowed to pass beneath the roller 22 and then over a block 110 as shown in FIG. 4.

Figure 2:
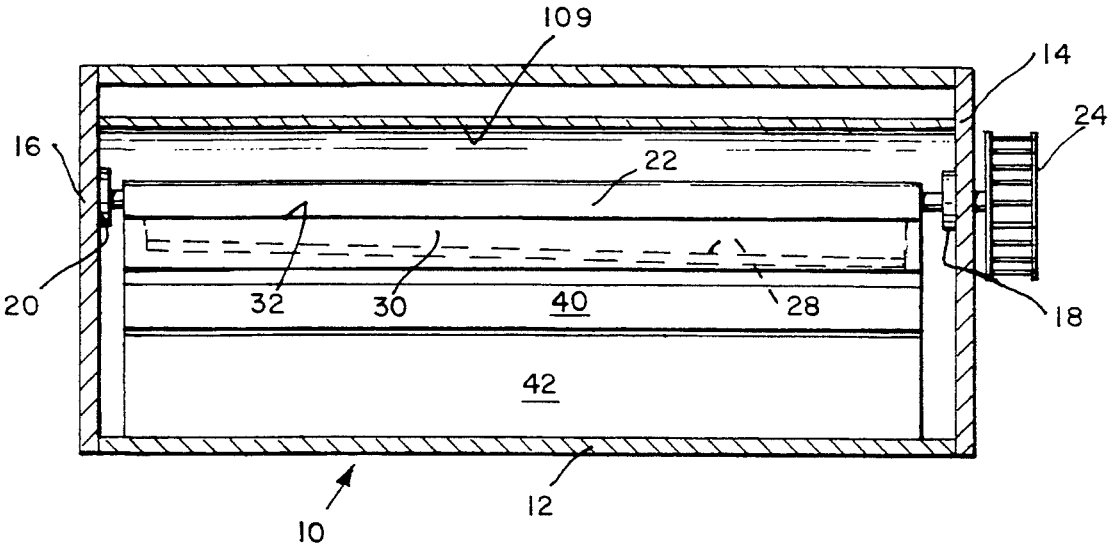
FIG. 2 is an elevational view of the web cutter of FIG. 1 taken along line 2—2 in FIG. 1 in the direction of the appended arrows.

It is important to understand the relative position of stationary edge 32 to cutting bar 26 and cutting edge 28. As can be seen in FIG. 2, they are not parallel to one another. FIG. 2 shows that the portion of stationary edge 32, near the opposite end 16, is farther from cutting bar 26 than is at driven end 14. This non-parallel relationship, when combined with the traverse mounting of cutting bar 26 on roller 22, causes cutting edge 28 to first contact that portion of stationary edge 32 near driven end 14 during each rotational cycle of the roller 22.

When the cutting edge 28 engages the stationary edge 32, it will cause the cantilever spring 40 to deflect downward in the region of driven end 14. This downward deflection will cause the end of the cutting edge 28 to slip past the stationary edge 32.

Because of the non-parallel relationship between cutting edge 28 and stationary edge 32, the point of contact moves across plate 30 from the driven end 14 to the opposite end 16. As the point of contact or interference moves across the plate 30, it will encounter the continuous web 50 which is severed by the scissors like action.

Referring now to FIGS. 3 and 4, continuous web 50 is fed between a drive roller 104 and a pinch roller 106. When the web 50 reaches cutting edge 32, it is in position to be cut. Due to the fact that cutting bar 26 begins to cut continuous web 50 near the driven end 14, the portion of the continuous web 50 that is not yet severed will tend to buckle upward slightly.

This condition is only momentary and will cease once the cut is completed. In order to ensure an accurate cut, a plate 108 has been provided to control and limit this buckling action. Once continuous web 50 has traveled beneath roller 22 it slides between a guide 109 and a block 110. FIG. 4 illustrates the position of roller 22, prior to a severing of the continuous web 50. As shown in FIG. 3, the cut portion of the continuous web 50 is a document of desired length.

In operation, the roller 22 makes one rotation per cut of the continuous web 50. It begins at a ready position, as shown in FIG. 4 and then makes one complete revolution per cut, coming back to a ready position. The intermediate position, just after a cut is shown in FIG. 3 which, in the preferred embodiment, is reached after a shaft rotation of less than 60°. However, the rotation of the roller 22 may be made continuous, that is, the roller 22 need not stop at any point in its rotation if very short documents are required. The roller 22 may also be made to come to stops of varying duration during each cycle, so that it is possible to cut the continuous web 50 into sheets of various desired lengths.

Figure 5:
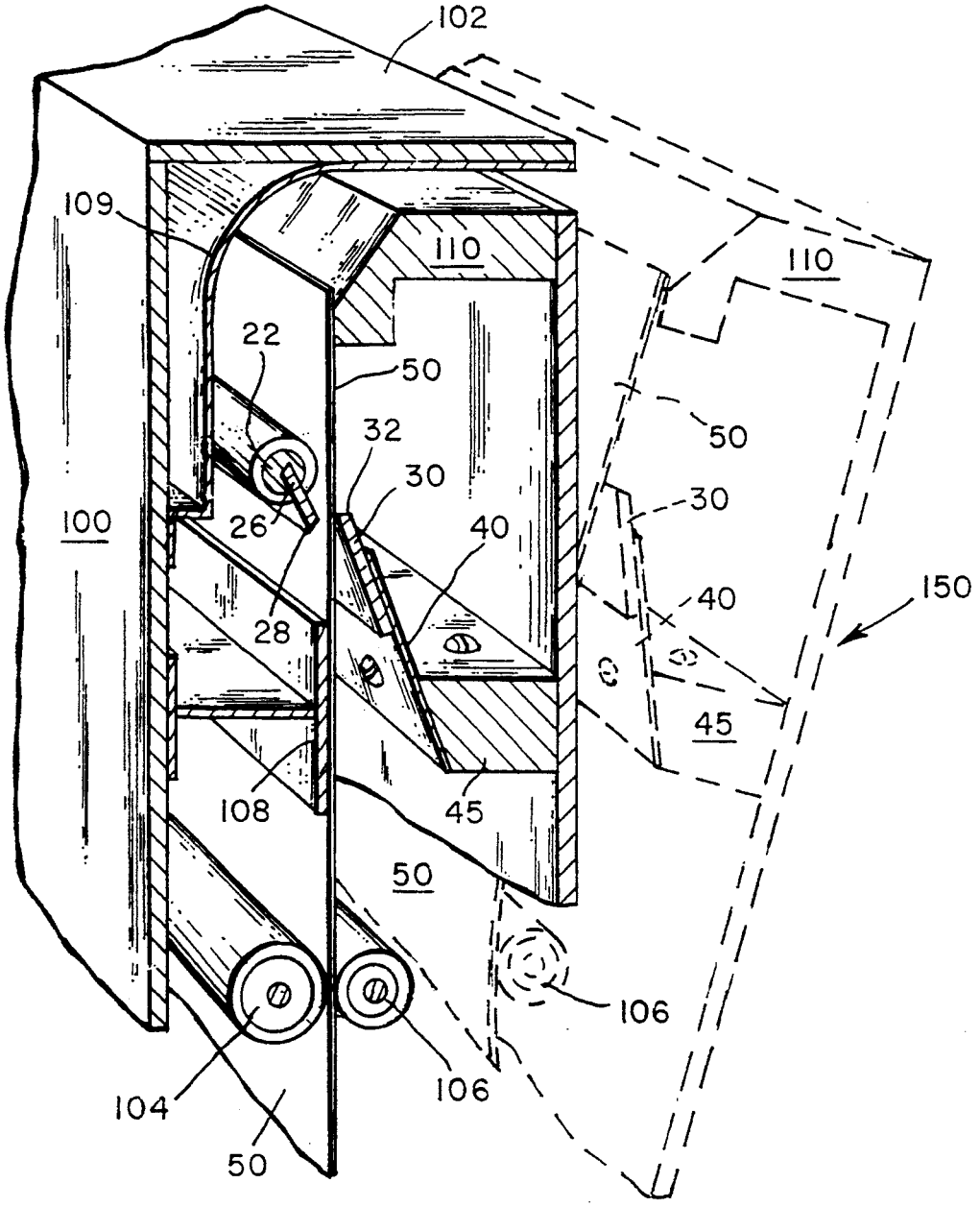
FIG. 5 is an elevational view of the invention without a side frame and latching mechanism, the invention in its open position being drawn in phantom.

Referring now to FIG. 5, cutter 10 is depicted in its preferred embodiment, which is comprised of two main assemblies, a chassis 100 and a hinged door 150. Door 150 is hinged at its bottom edge so that it swings outward and down for facilitating web loading. For purposes of illustration the side panels of chassis 100 and door 150, along with a latching means, have been omitted from FIG. 5. In the preferred embodiment of the invention, cutter 10 is located at the top or output end of a larger apparatus, such as a high speed printer. The printing function has not been illustrated in that it is not necessary to this invention.

FIG. 5 depicts the paper cutter assembly in two different positions, a closed position and (depicted in phantom) an open position. The open position is used to ease the loading of web material through the apparatus. In order to load a continuous web material, hinged door 150 is unlatched and moved away from chassis 100, as shown by the phantom lines in FIG. 5. Web material 50 is then pulled upward above the top of the cutter 10. The hinged door 150 is then closed and latched. The web material is then automatically positioned for the cutting operation.

Chassis 100 has a frame 102 which is constructed of a durable, preferably metal material and is formed integrally with a printer frame (not shown). As is illustrated in FIG. 5, web 50 is driven vertically by a drive roller 104 and a pinch roller 106. As the web 50 moves upward, it passes along adjacent to guide 108 and then continues between rotating cutting bar 26 and stationary edge 32 of plate 30.

As illustrated in FIGS. 3, 4 and 5, web material 50 is moving through paper cutter 10, cutting bar 26 is not rotating, but is located at a ready position, out of the path of web material 50. At the appropriate time, cutting bar 26 will make one revolution and sever web material 50 by making a cut across web material 50, in a direction that is perpendicular to the travel path of the web. The cutting action requires less than 60 ° of rotation. Rotating cutting bar 26 will then return to its ready position out of the path of web material 50. If the printer cutter is being operated at high speed, this cutting cycle may occur several times per second.

Once web material 50 has moved past the cutting bar 26, it is directed out of the cutter 10 by a deflecting guide 109 and a block 110. The path of web material 50 at this point is clearly illustrated in FIG. 4. Severed documents may be collected by an operator or accumulated in a bin for later processing.

Even though numerous characteristics and advantages of the invention have been set forth in the foregoing description, together with details of the structure and function of the invention, the disclosure is illustrative only, and changes may be made in detail, especially in matters of shape, size and arrangement of the parts, within the principles of the invention. Accordingly, the scope of the invention should be limited only by the breadth of the claims appended hereto.

What is claimed as new is:

1. A web cutter to be used in conjunction with a web transport system having a web support surface, the cutter comprising:

a) a rotatable shaft;

b) a frame supporting said shaft;

c) drive means for rotating said shaft;

d) a first cutter bar including a cutting edge mounted longitudinally on said shaft and rotatable therewith, with said cutting edge directed substantially outwardly therefrom, said cutter bar being slightly helical about said shaft;

e) a cantilever spring having a fixed edge and a free edge, said fixed edge being attached to said frame; and f) blocking means in the form of a second cutter bar attached to said spring free edge for performing a cutting function by partially impeding the path of said first cutter bar and thereby contacting a portion of said first cutter bar and by said first cutter bar displacing said blocking means in an arcuate path with rotational direction opposite that of said first cutter bar, said first cutter bar portion clearing said blocking means to form a moving point of contact between the cutting edge of said first cutter bar and said blocking means which moves with the rotation of said shaft.

2. The web cutter of claim 1, wherein said cantilever spring is mounted on support means at a distance from said frame.

3. The web cutter of claim 1, wherein the duration of contact between said first cutter bar and said second cutter bar is less than 60 degrees of shaft rotation.

4. The web cutter of claim 1, wherein said web is composed of paper.

5. The web cutter of claim 1, wherein said first cutter bar is replaceable.

6. The web cutter of claim 1, wherein said first cutter bar edge is sharpened.

7. The web cutter of claim 1, wherein said second cutter bar is replaceable.

8. The web cutter of claim 1, wherein said second cutter bar is sharpened.

9. An apparatus to be used in cooperation with a continuous supply of web material for cutting the web material into selectable lengths, comprising, in combination:

a roller with an extended bar having an angled cutting edge extending in a substantially axial direction;

means for rotating said roller; and blocking means in the form of a plate having an angled cutting edge, said blocking means being mounted on a relatively stiff cantilever spring, both said bar edge and said plate edge being in planes that are not parallel with the plane of said supply of web material but are at a predetermined angle with respect to said plane, said blocking means arranged for performing a cutting function by partially impeding the path of said extended bar and thereby contacting a portion of said extended bar and by said extended bar displacing said blocking means in an arcuate path with rotational direction opposite that of said extended bar, said extended bar portion clearing said blocking means to form a moving point of contact between the cutting edge of said extended bar and said blocking means which moves with the rotation of said roller.

10. The apparatus of claim 9 wherein the web material is paper.

11. High speed web cutter apparatus, comprising:

a U-shaped frame having a horizontal bottom plate with two opposing ends including a first end located at one end of said plate and perpendicular to the surface of said plate and a second end located at the opposite end of said plate and perpendicular to the surface of said plate, said first and second ends containing bearings for supporting a roller;

a roller having a first end supported by said first end bearing and a driven end including an extending portion which extends beyond said second end supported by said second end bearing;

a first cutter bar having a cutting edge, said cutter bar being axially mounted at the circumference of said roller and slightly skewed with respect to the axis of said roller and extending outwardly therefrom;

a pulley mounted on said extending portion of said roller;

means for selectively rotating said pulley;

support means fixedly attached to said horizontal plate and including a cantilever spring mounted on a surface of said support means, said spring having a free edge which extends from said support means toward said roller and said first cutter bar and blocking means in the form of a second cutter bar attached to said spring free edge for performing a cutting function by partially impeding the path of said first cutter bar and thereby contacting a portion of said first cutter bar and by said first cutter bar displacing said blocking means in an arcuate path with rotational direction Opposite that of said first cutter bar, said first cutter bar portion clearing said blocking means to form a moving point of contact between the cutting edge of said first cutter bar and said blocking means which moves with the rotation of said roller.

12. The web cutter of claim 11, wherein said second cutter bar is not in parallel alignment with said first cutter bar edge.

13. The web cutter of claim 11 wherein said first cutter bar is removable.

14. The web cutter of claim 11 wherein said first cutter bar is sharpened.

15. The web cutter of claim 11 wherein said second cutter bar is removable.

16. The web cutter of claim 11 wherein said second cutter bar is sharpened.

* * * * *